US009868221B2

(12) United States Patent
Van Eibergen Santhagens

(10) Patent No.: US 9,868,221 B2
(45) Date of Patent: Jan. 16, 2018

(54) BENT RAZOR BLADES AND MANUFACTURING OF SUCH RAZOR BLADES

(71) Applicant: KONINKLIJKE PHILIPS ELECTRONICS N.V., Eindhoven (NL)

(72) Inventor: Robert Alexander Van Eibergen Santhagens, De Wilgen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 85 days.

(21) Appl. No.: 13/790,913

(22) Filed: Mar. 8, 2013

(65) Prior Publication Data

US 2013/0185942 A1 Jul. 25, 2013

Related U.S. Application Data

(60) Division of application No. 13/164,004, filed on Jun. 20, 2011, now abandoned, which is a continuation of (Continued)

(30) Foreign Application Priority Data

Jun. 26, 2003 (EP) ..... 03101899

(51) Int. Cl.
*B26B 21/56* (2006.01)
*B21D 53/64* (2006.01)

(Continued)

(52) U.S. Cl.
CPC ..... *B26B 21/565* (2013.01); *B21D 53/645* (2013.01); *B26B 21/22* (2013.01); *B26B 21/40* (2013.01)

(58) Field of Classification Search
CPC ..... B26B 21/22; B26B 21/565; B26B 21/222; B26B 21/4012; B26B 21/4068; B26B 21/227; B26B 21/40; B21D 53/645

(Continued)

(56) References Cited

U.S. PATENT DOCUMENTS 972,436 A * 10/1910 Clark ..... 76/101.1
1,672,516 A 6/1928 Drew (Continued)

FOREIGN PATENT DOCUMENTS

DE 877617 C 5/1953
DE 954702 C 12/1956

(Continued)

OTHER PUBLICATIONS

Bao et al. "Analysis and Predication of Edge Effects in Laser Bending", Feb. 2001, vol. 123, pp. 53-61, Journal of Manufacturing Science and Engineering. [online], [retrived on Oct. 27, 2015].*

(Continued)

*Primary Examiner* — Jennifer Swinney

(57) ABSTRACT

A razor blade includes an edge portion with a cutting edge at a first end of the razor blade; a further portion extending from the edge portion to a second end of the razor blade; and a bridge portion attached to a first portion of the further portion, leaving a second portion of the further portion exposed from the first end to the second end. The edge portion is bent relative to the further portion through an angle of at least 40° in a bending zone spaced from the cutting edge. Further, at least the edge portion has a material structure hardened by a first heat treatment, and the bending zone has a locally re-heated structure.

10 Claims, 2 Drawing Sheets

Related U.S. Application Data application No. 10/561,468, filed as application No. PCT/IB2004/050976 on Jun. 23, 2004, now abandoned.

(51) Int. Cl.
*B26B 21/22* (2006.01)
*B26B 21/40* (2006.01)

(58) Field of Classification Search
USPC ..... 30/346.57, 353, 346.6, 41.7, 48, 49, 50, 30/346.5
See application file for complete search history.

(56) References Cited

U.S. PATENT DOCUMENTS

| | | | | | |
|---|---|---|---|---|---|
| 1,914,013 | A | | 6/1933 | Gaisman | |
| 1,920,711 | A | * | 8/1933 | Pelizzola | 30/50 |
| 2,087,051 | A | * | 7/1937 | Stargardter | 428/602 |
| 3,224,900 | A | | 12/1965 | Creamer et al. | |
| 3,431,624 | A | | 3/1969 | Pickel | |
| 3,461,616 | A | | 8/1969 | Nissen et al. | |
| 3,489,589 | A | | 1/1970 | Nissen | |
| 3,644,992 | A | | 2/1972 | Bennett et al. | |
| 3,852,883 | A | * | 12/1974 | Ferraro | 30/346.58 |
| 3,938,250 | A | | 2/1976 | Perry | |
| 4,200,976 | A | | 5/1980 | Gooding | |
| 4,275,498 | A | | 6/1981 | Ciaffone | |
| 4,302,876 | A | * | 12/1981 | Emmett | 30/47 |
| 4,378,634 | A | | 4/1983 | Jacobson | |
| 4,389,773 | A | * | 6/1983 | Nissen et al. | 30/50 |
| 4,442,598 | A | * | 4/1984 | Jacobson | 30/47 |
| 4,551,916 | A | | 11/1985 | Jacobson | |
| 4,860,452 | A | | 8/1989 | Guarnaccia et al. | |
| 5,010,646 | A | * | 4/1991 | Neamtu | 30/50 |
| 5,067,238 | A | | 11/1991 | Miller et al. | |
| 5,305,526 | A | * | 4/1994 | Althaus | 30/77 |
| 5,359,872 | A | * | 11/1994 | Nashiki | B21D 5/00 219/121.62 |
| 5,373,638 | A | | 12/1994 | Coffin | |
| 5,433,801 | A | | 7/1995 | Althaus et al. | |
| 5,761,814 | A | | 6/1998 | Anderson et al. | |
| 5,822,862 | A | | 10/1998 | Ferraro | |
| 6,216,349 | B1 | | 4/2001 | Gilder et al. | |
| 6,415,639 | B1 | | 7/2002 | Kilian et al. | |
| 6,601,303 | B2 | | 8/2003 | Gilder et al. | |
| 8,499,462 | B2 | * | 8/2013 | Masek et al. | 30/346.54 |
| 2002/0035786 | A1 | | 3/2002 | Gilder et al. | |
| 2002/0108427 | A1 | * | 8/2002 | Matsushita | B23K 26/04 72/342.1 |
| 2003/0204955 | A1 | * | 11/2003 | Gilder et al. | 30/50 |

FOREIGN PATENT DOCUMENTS

| | | | | | |
|---|---|---|---|---|---|
| DE | 2918100 | | | 11/1980 | |
| DE | 37280041 | A1 | | 3/1989 | |
| EP | 0109509 | B1 | | 5/1984 | |
| FR | 2663255 | A2 | * | 12/1991 | |
| GB | 1102041 | | | 2/1968 | |
| GB | 2055069 | A | * | 2/1981 | B26B 21/54 |
| GB | 1598352 | A | * | 9/1981 | |
| WO | 9310947 | A1 | | 6/1993 | |
| WO | 9504637 | A1 | | 2/1995 | |
| WO | 9610833 | | | 4/1996 | |
| WO | 0232633 | A2 | | 3/2002 | |

OTHER PUBLICATIONS

Liu, et al. "Three-dimensional Numerical Study on Temperature Field of Laser Bending of Sheet Metal", Nov. 2003, vol. 19, pp. 59-61, J. Mater Sci. Technol. [online], [retrieved on Oct. 27, 2015].*
Specialty Blades, Inc., "Heat-Treated Stainless Steel", Staunton, VA, 2003, 6 Pages.

* cited by examiner

BENT RAZOR BLADES AND MANUFACTURING OF SUCH RAZOR BLADES

This application is a divisional of U.S. patent application Ser. No. 13/164,004 filed on Jun. 20, 2011, which is continuation of U.S. patent application Ser. No. 10/561,468 filed on Dec. 20, 2005, which is a national stage application under 35 U.S.C. §371 of International Application No. PCT/IB2004/050976 filed on Jun. 23, 2004, which claims priority to European Application No. EP03101899.7 filed on Jun. 26, 2003, each of which is incorporated herein by reference.

This invention relates to a razor blade, to a razor unit including such razor blades, to a method of manufacturing razor blades, and to a device for manufacturing razor blades. Such a razor blade and such a method are known from U.S. Pat. No. 4,302,876.

Modern safety razors for wet shaving usually have two or more razor blades arranged with their cutting edges and edge portions parallel to each other. Some razors of a disposable type form an integral razor unit in which the razor blades are suspended. Other razor units form replacement units adapted to be removably mounted in the head of a razor as a replacement when the razor blades are worn.

The cutting edges are located close to each other for providing a comfortable clean shaving result and a reduced risk of cutting injuries. A problem that arises from the use of such systems is the accumulation of debris between the blade cutting edges, particularly in shaving devices with long-lasting razor blades where a long period of use allows the accumulation of large amounts of debris.

In the aforementioned U.S. Pat. No. 4,302,876, a razor blade assembly is described that is easier to rinse because the major portion of at least one of the razor blades is bent at a substantial angle to its edge portion, so that the gap between the major portions of the razor blades is larger than the gap between the edge portions.

Bent razor blades are also described in U.S. Pat. No. 3,938,250, U.S. Pat. No. 4,389,773 and U.S. Pat. No. 5,010,646 and in WO-A-02/32633. The latter document describes that the bent configurations of the blades are obtained by bending flat razor blades by pressing them between upper and lower tool members. Thus, it was recognized already a long time ago that several advantages are associated with bent razor blades.

However, in practice such razor blades have never been manufactured commercially (or at least not on a scale that is of significance in a mass market such as that of razor blades). Instead, where razors are equipped with a plurality of razor blades, the razor blades are conventionally straight and mounted on a carrier that is in some cases of a bent material that is much softer than the metal of a razor blade. However, this requires the carriers to extend to close to the shaving edges, which entails the aforementioned disadvantage of substantially constricting the interspaces between the razor blades and therefore clogging up of the gaps between the razor blades.

It is an object of the invention to provide a solution that allows durable razor blades, that are bent through a substantial angle to be efficiently, reliably and accurately manufactured on a large scale.

Razor blades are made of hard material such as steel that is hardened by heat treatment. Local heating allows the hardened material of the blanks to be bent, so that the need of handling bent blanks in preparation of and directly after hardening is avoided and the bend or fold, which has been bent in the blank can be controlled accurately.

The local heat treatment can be carried out in a narrow, sharply delimited area by irradiating with a laser.

The need of handling bent blanks is further reduced if also the grinding of each blank is carried out before the bending of that razor blade. Furthermore, grinding before bending allows the razor blades to be ground in a conventional grinder, grinding the cutting edge from both sides of the blank. Accordingly, in a system for manufacturing razor blades including a transport track for transporting the blanks, the grinding station is preferably located upstream of the bending station.

Further aspects, effects and details of the invention are described below with reference to examples of methods, razor blades and a manufacturing device according to the invention. In the figures.

Figure 1:
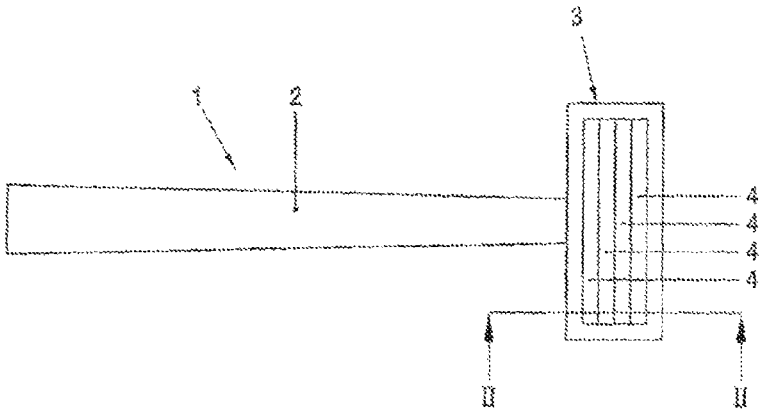
FIG. 1 is a plan view of a razor unit according to the invention including razor blades according to the invention.
Figure 2:
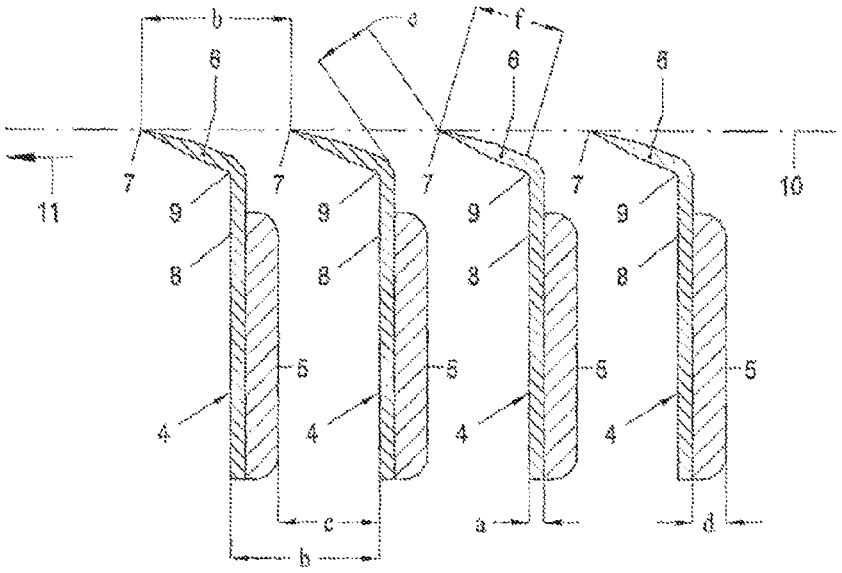
FIG. 2 is a side view in cross-section along the line II-II in FIG. 1 of the razor blades and the support bridge portions of the razor unit according to FIG. 1.

In FIGS. 1 and 2 a razor unit 1 according to the invention for wet shaving is shown. The razor unit 1 according to this example is an integrated razor 1 and includes a handle 2 and a shaving head 3. The shaving head 3 carries four razor blades 4 in accordance with the invention, which are attached to and supported by bridge portions 5 of the razor head 3. The razor unit 1 may also consist of razor blades mounted in a support for removable mounting in a shaving head or to a handle. The attachment of the razor blades 4 to the razor head 3 may for instance be realized in a conventional manner, such as by an adhesive or plastic welding.

The razor blades 4 each have an edge portion 6 with a cutting edge 7 and a further portion 8 bent relative to the edge portion 6 in a curved area 9. According to this example, the edge portions 6 are planar blade portions. The cutting edges 7 of the razor blades 4 are located close together in shaving direction 11 for providing a comfortable shave and reducing the risk of cutting injuries. The cutting edges 7 define a shaving plane 10 that approximately forms the plane along which the skin surface to be shaved extends when the razor unit 1 is in use.

The edge portions 6 of the razor blades 4 are inclined at acute angles relative to the shaving plane 10, so that a comfortable shaving effect is achieved and wear of the cutting edges 7 is reduced. The small distance between the cutting edges 7 in the shaving direction 11 along the shaving plane 10 in combination with the inclination of the edge portions 6 of the razor blades 4 relative to the shaving plane 10 has the result that the interspaces e between the edge portions 6 of neighboring razor blades 4 are quite narrow. Because the major portion 8 of at least one of the razor blades 4 is bent through a substantial angle to its edge portion 6, the gaps b between the major portions 8 of the razor blades 4, which are identical to the spacing b between the cutting edges 7, are larger than the gaps e between the edge portions 6. This facilitates the flushing of shaving debris from the narrowest gap e. If water is flushed in on the cutting edge side of the gaps, the outflow of shaving debris from the narrowest gaps e encounters little resistance and clogging them with shaving debris from the area of the cutting edges 7 is counteracted, because the gaps widen in a direction away from the cutting edges 7. If water is flushed through the gaps in the opposite direction, i.e. is caused to flow out of the gaps at the ends of the gaps between the cutting edges 7, the gaps become narrower towards the downstream end. This causes a pressure build-up in the water flow in the area of the edge portions 6 adjacent the cutting edges 7, from where most shaving debris is to be removed. Thus, the bent shape of at least one of the razor blades 4 causes the width of the gaps between the razor blades 4 to increase with the distance from the cutting edge area, and this makes flushing away of shaving debris in the area of the cutting edges easier. Also blowing away shaving debris from between the razor blades 4 with air is facilitated by the described configuration of the gaps.

To further facilitate the flushing and to keep the minimum width c of the gaps in the direction of the plane 10 relatively large, the bridge portions 5 have a slender cross-section, each having a width d of preferably no more than three time the thickness a of the razor blades 4, and rounded edges.

It is observed that the improved ease of rinsing allows the spacing between the cutting edges 7 of successive razor blades 4 to be reduced, for instance down to less than 1.2, 1 or even 0.8 mm, without making the rinsing of the gaps between the razor blades 4 more difficult than in conventional razors. In turn, the relatively narrow gaps between the razor blades 4 may be used for providing a more compact and maneuverable razor head or, as in the present example, for increasing the number of razor blades 4 in the razor head 3 to four or more.

The razor blades 4 each have a blade material thickness a, and the bending zone 9 is close to the tip of the cutting edge 7, so that the constriction e of the gaps between neighboring razor blades 4 widens very near to and preferably directly from the cutting edges 7, and a stiffness increase is achieved close to the cutting edge 7 where cutting loads are exerted onto the razor blade 4. Preferably the bending zones 9 are each located less than 1 mm and more preferably less than 0.7 mm from the cutting edge 7 of the same razor blade 4. The blade material thickness a may for instance be 0.1 mm.

A short distance between the cutting edge 7 and the bending zone 9 of each razor blade 4 is also advantageous, because it allows positioning the razor blades 4 close to each other. Preferably, the distance between successive razor blades 4 is such that the edge portions 6 that are bent towards a neighboring razor blade 4 remain clear of a plane forming a continuation of the further portion 8 of that neighboring razor blade 4. In other words, the edge portions 6 that are bent towards a neighboring one of the razor blades 4 preferably project towards that neighboring razor blade 4 over a distance perpendicular to the further blade portion 8 of that razor blade 4 that is smaller than the spacing between the further portions 8 of these razor blades 4. This allows spraying water straight through the gap between the successive razor blades 4.

Furthermore, the bending zone 9 preferably has a larger thickness than the blade material thickness, so that a further stiffening of the razor blade 4 is obtained close to the cutting edge 7.

Figure 3:
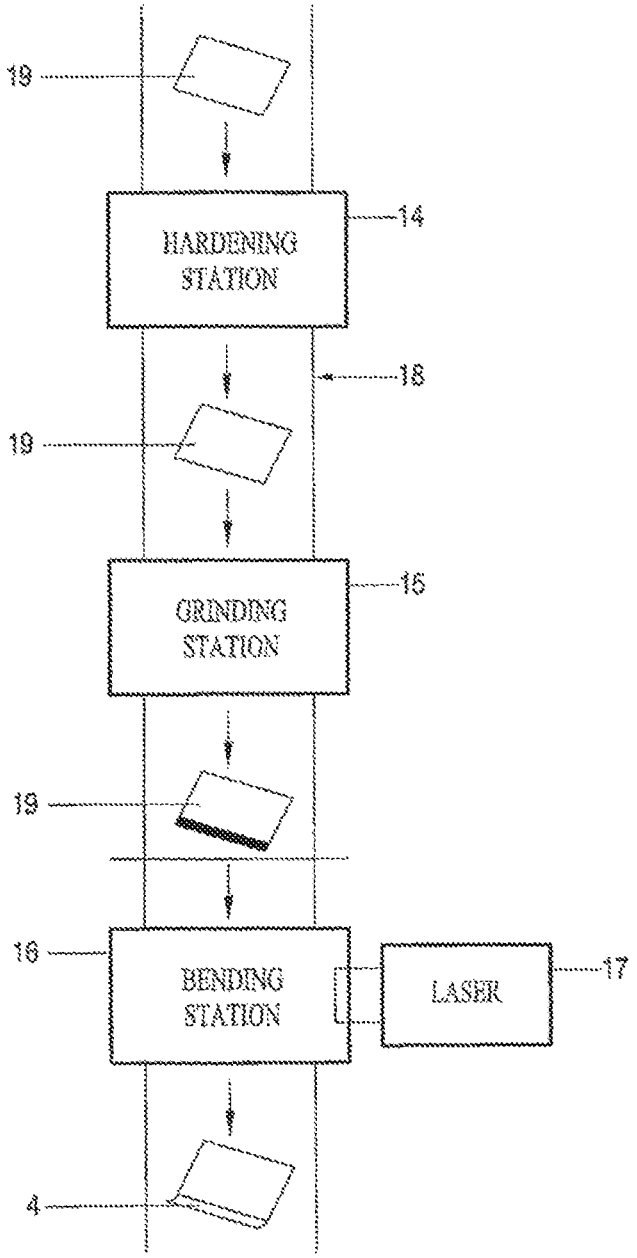
FIG. 3 is a diagrammatic representation of a device for manufacturing razor blades according to the invention.

A device for manufacturing a razor blade 4 with an edge portion 6 with a cutting edge 7 and a further portion 8 bent relative to that further portion 8 is shown in FIG. 3.

The device includes a hardening station 14 for hardening blanks 19 from which the razor blades 4 are to be made, a grinding station 15 for grinding the hardened razor blades 4, a laser bending station 16 for bending the hardened razor blades 4, and a transport path 18 for transporting the blanks 19, from which razor blades 4 are manufactured, from the hardening station 14 to the grinding station 15 and then to the bending station 16. The bending station is provided with a laser source 17.

In operation, the blanks 19 from which the razor blades 4 are made are first hardened by thermal treatment in the hardening station 14. At least the cutting edges 7 of the razor blades 4 are very hard to achieve sufficient resistance to wear, the hardness being usually more than 650 HV and preferably more than 700 HV. Because of its corrosion resistance, heat treated (martensitic) stainless steel, preferably having a carbon content of at least 0.5% and preferably between 0.5 and 1.25%, is preferred for wet shaving. However, the razor blades 4 may be made of other types of steel hardened by heat treatment, such as carbon steel and high speed steel, as well. Also plasma nitrited steel is hardened and suitable as a material for razor blades 4. A particularly durable razor blade 4 can be obtained if it is made of tungsten carbide. The razor blades 4 may further be provided with coatings, for example for reducing wear and friction and for improving corrosion resistance.

The blanks 19 are transported along the transport path 18 to the grinding station 15 where the cutting edge 7 is ground. Handling of the blanks 19 is relatively easy, because the blanks 19 are in an essentially flat condition. According to the present example, processing of the blanks 19 is facilitated particularly because the blanks 19 are flat during and directly after hardening and during and directly after grinding.

Finally, the blanks 19 are transported along the transport path 18 to the bending station 16, where the edge portions 6 of the blanks 19, that have been ground so that cutting edges 7 have been formed, are bent relative to the further portion 8 of the blank 19. The further portion 8 of the blank 19 may also be bent along a fold line once or more times, so that two or more bends or folds are obtained.

The bending of the hardened blank 19 includes locally heating portions of the blanks 19. The bending may be achieved or at least supported by exerting a bending moment to the heated portions. Because the bending moment is exerted to the material while it is heated, preferably to at least 500° C., the blanks 19 can be bent through a substantial angle and with a relatively small radius of curvature after hardening. Furthermore, because the blanks 19 are heated locally only, the cutting edges 7 are not affected by the heating, so that the sharpness and hardness of the cutting edges 7 is maintained.

The bending moment may be exerted statically, so that the blanks 19, which are heated most on one side, are prevented from bending. As a result, the material is deformed and then bent as the deformed heated side of the heated portion of the blank 19 shrinks while cooling. The bending moment may also be exerted dynamically by a tool that is movable or by a tool that is deflected in the transport direction of the blanks 19 (parallel to the orientation of the cutting edges 7) to actively bend the hot portions of the blanks 19. A combination of bending by moving a tool and bending due to shrinkage during cooling is also possible.

According to the present example, the local heating of the blanks 19 is carried out by local irradiation of the area where the blank 19 is to be bent with a laser. This allows a particularly accurate control over the bending of the hardened blank. Laser bending preferably involves intermittently irradiating the fold line or bending zone of a blank with laser light, either by scanning along the line or zone and/or by generating a suitably shaped laser light beam. The laser beam emitted from the laser source is directed to a face of the blank 19 to be bent, causing the portion of the blank 19 to be deformed to be heated and cooled very quickly. During cooling, the material at the irradiated side shrinks, so that the blank 19 becomes convex in the irradiated area.

Thus, the bending does not require the exertion of mechanical forces on the blank 19. This is particularly favorable for bending very closely along the cutting edge, which would require the exertion of large forces to load the bending area with a given bending moment, which may easily lead to damage to the cutting edge.

Another reason why causing the blanks 19 to bend by irradiation with a laser is particularly suitable for bending very closely along the cutting edge is that the heating can be carried out in a very accurately delimited area only, so that it can be reliably ensured that the cutting edges 7 are not affected by the local heat treatment, even if the bending area is located very close to the cutting edge 7.

Another advantage of bending by intermittently irradiating with a laser is that the material thickness is increased in the area where the bend is made. This provides additional rigidity and provides at least partial compensation if loss of specific strength occurs due to the bending operation.

However, mechanical tools or supports deflected in the transport direction causing the blanks 19 to bend as they are transported may also be used to exert a moment on the laser irradiated portions of the blanks 19 causing these portions to bend.

The blanks 19 are bent through a substantial angle (preferably at least 40°) with a small radius of curvature, preferably less than two times the material thickness. A small radius of curvature is advantageous for accurate control of the bending operation.

A laser light-absorbing agent may be applied on one surface of the blank transmitting a laser light to improve the energy absorption in the irradiated area.

It will be clear to the skilled person that within the framework of the present invention, of which embodiments are set forth in the claims, many other alternative methods, systems and razor blades are conceivable. For instance, while the transport path is shown diagrammatically as a path extending through the stations 14-16, it may be provided in the form of any suitable structure for transporting blanks individually or batchwise from the hardening station 14 to the bending station 16, either directly or via one or more other stations such as the grinding station 15, and it does not need to extend through the station or stations. Furthermore, the razor blade does not need to be a razor blade for a manual wet shaving implement, but may also be a razor blade suitable for use in, for instance, an electric shaver, which may be suitable for wet and/or lotion enhanced shaving.

The invention claimed is:

1. A razor unit comprising:

a razor blade having an edge portion with a cutting edge at a first end;

the edge portion transitions to a bending zone and the bending zone transitions into a further portion of the blade;

the further portion extending from the bending zone to a second end of the razor blade, the further portion having a front portion and a rear portion; and a bridge portion attached only to the rear portion of the further portion along a first portion of the further portion, leaving a second portion of the further portion exposed from the first end to the second end, wherein the bending zone has a thickness that is larger than a blade material thickness to provide additional rigidity in the bending zone, and wherein at least the edge portion has a material structure hardened by a first heat treatment, and wherein the bending zone has a locally re-heated structure, wherein said local re-heating is performed by local intermittent laser irradiation without requiring the exertion of mechanical forces, wherein the local intermittent laser irradiation provides the bending zone over an angle of at least 40 degrees within 0.7 mm of the cutting edge without influencing the material properties of the cutting edge thereby maintaining the quality of the cutting edge at the first end of the razor blade.

2. The razor blade of claim 1, wherein the bridge portion has rounded ends.

3. The razor blade of claim 1, wherein the bridge portion has a width of no more than three times a thickness of the razor blade.

4. The razor blade of claim 1, wherein the bridge portion is shorter than the further portion.

5. A multi-blade razor unit comprising: at least two razor blades mounted parallel to each other in a razor head, each razor blade of the at least two razor blades comprising:

an edge portion with a cutting edge at a first end of the razor blade;

the edge portion transitions to a bending zone and the bending zone transitions into a further portion of the blade;

a further portion extending from the bending zone to a second end of the razor blade, the further portion having a front portion and a rear portion, a bridge portion attached only to the rear portion of the further portion along a first portion of the further portion, leaving a second portion of the further portion exposed from the first end to the second end, the edge portion being bent relative to the further portion through an angle of at least 40° in the bending zone spaced from said cutting edge, and wherein a spacing is present between further portions of at least two of said at least two razor blades, wherein the edge portion of at least one of said at least two razor blades is bent in a substantially horizontal plane towards at least one neighboring one of said at least two razor blades and projects towards said at least one neighboring one of said at least two razor blades forming a first spacing between the respective adjacent edge portions of the at least two of said razor blades which is smaller than a second spacing between the further portions of the at least two of said razor blades, wherein the bending zone is located less than 0.7 mm from the cutting edge and has a thickness that is larger than the blade material thickness to provide additional rigidity in the bending zone, and wherein the second spacing between the further portions of the at least two of said razor blades is identical to a third spacing between the respective cutting edges of the at least two of said razor blades, wherein at least the edge portion has a material structure hardened by a first heat treatment, and wherein the bending zone has a locally re-heated structure, wherein said local re-heating is performed by local intermittent laser irradiation without requiring the exertion of mechanical forces, wherein the local intermittent laser irradiation provides the bending zone over the angle of at least 40 degrees within 0.7 mm of the cutting edge without influencing the material properties of the cutting edge thereby maintaining the quality of the cutting edge at the first end of the razor blade.

6. A multi-blade razor unit comprising at least two razor blades mounted parallel to each other in a razor head, each razor blade of the at least two razor blades comprising:

an edge portion at with a cutting edge a first end of the razor blade;

the edge portion transitions to a bending zone and the bending zone transitions into a further portion of the blade;

a further portion extending from the bending zone to a second end of the razor blade, the further portion having a front portion and a rear portion; and the bridge portion attached to only the rear portion of the further portion along a first portion of the further portion, leaving a second portion of the further portion exposed from the first end to the second end, the edge portion being bent relative to the further portion through an angle of at least 40° in a bending zone spaced from said cutting edge, wherein a first spacing is present between the cutting edges of at least two of said razor blades, the first spacing between successive cutting edges being equidistant and less than 0.8 mm, wherein the edge portion of at least one of said at least two razor blades is bent in a substantially horizontal plane towards at least one neighboring one of said at least two razor blades and projects towards said at least one neighboring one of said at least two razor blades forming the first spacing between adjacent edge portions which is smaller than a second spacing between further portions of the at least two of said razor blades, and wherein at least the edge portion has a material structure hardened by a first heat treatment, and wherein the bending zone has a locally re-heated structure, wherein said local re-heating is performed by local intermittent laser irradiation without requiring the exertion of mechanical forces, wherein the local intermittent laser irradiation provides the bending zone over an angle of at least 40 degrees within 0.7 mm of the cutting edge without influencing the material properties of the cutting edge thereby maintaining the quality of the cutting edge at the first end of the razor blade.

7. A multi-blade razor unit comprising:

at least four razor blades mounted parallel to each other in a razor head, each razor blade having:

an edge portion with a cutting edge and a further portion with a radius of curvature less than two times a material thickness of the blade in a bending zone spaced from said cutting edge, the edge portion transitions to a bending zone and the bending zone transitions into the further portion;

the further portion having a front portion and a rear portion, wherein a spacing is present between the cutting edges, the bridge portion attached to only the rear portion of the further portion along a first portion of the further portion, leaving a second portion of the further portion exposed from the first end to the second end, wherein the edge portion of at least one of said at least four razor blades is further bent in a substantially horizontal plane towards at least one neighboring one of said at least four razor blades and projects towards said at least one neighboring one of said at least four razor blades forming a first spacing between the adjacent edge portions which is smaller than a second spacing between further portions of the at least four of said razor blades, and wherein at least the edge portion has a material structure hardened by a first heat treatment, and wherein the bending zone has a locally re-heated structure, wherein said local re-heating is performed by local intermittent laser irradiation without requiring the exertion of mechanical forces, wherein the local intermittent laser irradiation provides the bending zone over an angle of at least 40 degrees within 0.7 mm of the cutting edge without influencing the material properties of the cutting edge.

8. The razor unit of claim 7, wherein the bridge portion has rounded ends.

9. The razor unit of claim 7, wherein the bridge portion has a width of no more than three times a thickness of the razor blade.

10. The razor unit of claim 7, wherein the bridge portion is shorter than the further portion.

* * * * *